United States Patent [19]

Bauer

[11] Patent Number: 4,845,934

[45] Date of Patent: Jul. 11, 1989

[54] FALSE TWISTED BULKY MULTIFILAMENT YARN, METHOD OF MAKING AND END USE OF THIS YARN

[75] Inventor: Günther Bauer, Königsbrunn, Fed. Rep. of Germany

[73] Assignee: Hoechst AG, Frankfurt, Fed. Rep. of Germany

[21] Appl. No.: 191,385

[22] Filed: May 9, 1988

[30] Foreign Application Priority Data

May 13, 1987 [DE] Fed. Rep. of Germany ..... 3715971

[51] Int. Cl.[4] ..... D02G 3/38; D02G 3/22; D02G 1/02

[52] U.S. Cl. ..... 57/747; 57/243; 57/244; 57/245; 57/246; 57/248; 57/6; 57/282

[58] Field of Search ..... 57/210, 211, 243, 244, 57/245, 246, 247, 248, 3, 6, 13, 282, 284, 287, 288

[56] References Cited

U.S. PATENT DOCUMENTS

| | | | |
|---|---|---|---|
| 2,461,094 | 2/1949 | Taylor | 57/245 X |
| 3,033,240 | 5/1962 | Bottorf | 57/245 X |
| 3,396,529 | 8/1968 | Stutz | 57/245 X |
| 3,439,490 | 4/1969 | Tarkington et al. | 57/245 X |
| 3,472,017 | 10/1969 | Nakayama et al. | 57/245 |
| 3,608,296 | 9/1971 | Taylor | 57/244 |
| 4,712,366 | 12/1987 | Tsujimoto et al. | 57/247 X |

FOREIGN PATENT DOCUMENTS

| | | |
|---|---|---|
| 2308031 | 9/1974 | Fed. Rep. of Germany . |
| 2934762 | 3/1980 | Fed. Rep. of Germany . |
| 2949881 | 7/1980 | Fed. Rep. of Germany . |

*Primary Examiner*—Donald Watkins

*Attorney, Agent, or Firm*—Harness, Dickey & Pierce

[57] ABSTRACT

A false twisted bulky synthetic multifilament yarn of a uniform polymer consisting of at least two filament bundles of different filament deniers, with the filaments in each of said bundles having the same denier per filament. The smaller denier per filament is less than 1 dtex, and the total denier of the texturized yarn is in excess of 100 times the finer filament denier. For the production of such a multifilament yarn, the draw ratios of both filament bundles are chosen such that the difference between both draw ratios is smaller than 0.1, and both bundles are drawtexturized simultaneously at a draw ratio corresponding to the draw ratio of the filament bundle having the coarser denier per filament. Preferred end uses of the yarn are water-repellent fabrics, dust proof fabrics, and the conductive component of sports wear.

10 Claims, 1 Drawing Sheet

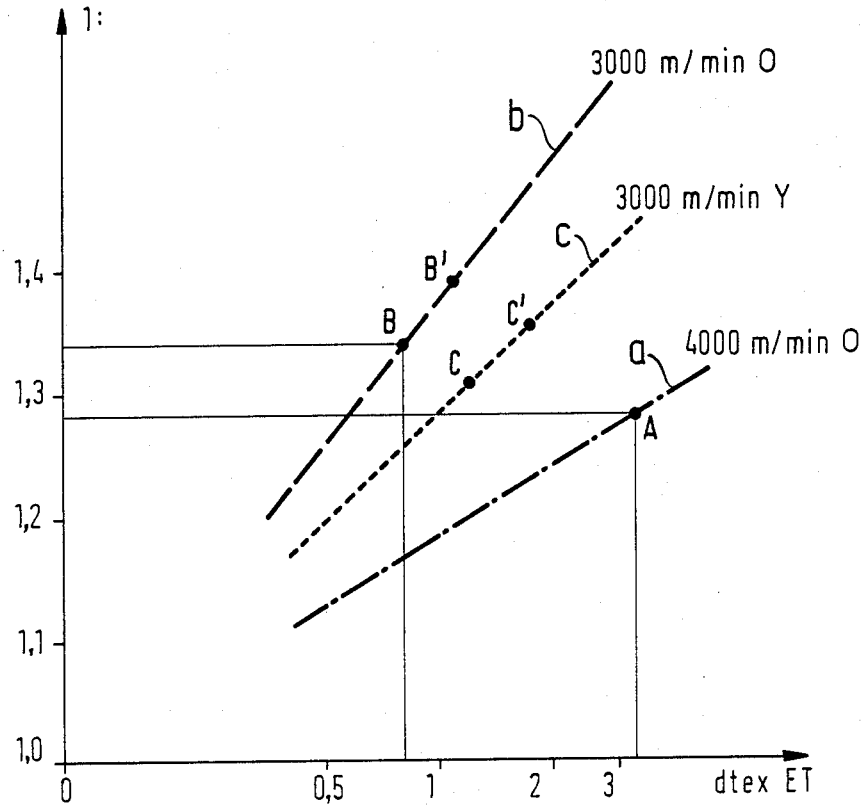
1:
3000 m/min O
b
3000 m/min Y
c
B'
C'
B
C
a
4000 m/min O
A
1,4
1,3
1,2
1,1
1,0
0
0,5
1
2
3
dtex ET

FALSE TWISTED BULKY MULTIFILAMENT YARN, METHOD OF MAKING AND END USE OF THIS YARN

The present invention relates to a false twisted bulky synthetic multifilament yarn of a uniform polymer, consisting of at least two filament bundles of different filament deniers $ET_1$ and $ET_2$, with the filaments in each of said bundles having the same denier per filament.

Texturizing by false twisting has proven to be the most economical texturizing method for endless multifilament yarns of a total denier of less than 200 dtex. However, with this method it has not yet been possible to make a fluffless yarn having more than about 100 filaments. The finest multifilament yarn of polyethylenterephthalat (PET) produced in practice has a denier of 56 dtex f 100. With respect to fine filament denier texturized yarns for the use in woven and knit fabrics the following has been found in practice:

An untangled yarn of a denier of 55f46 may be generally used. A yarn of a denier of 55f46×2 can be used only as a tangled warp yarn in high speed looms. A yarn of a denier of 55f46×3, even if tangled, is too fluffy to be used as a warp yarn in the weaving industry. A yarn of a denier of 55f46×4 may be used only in areas of a highly insensitive nature.

Multifilament yarns having a higher total denier, e.g. of 150 dtex f 250, are preferrably texturized by the air texturizing method. Woven, warp-knitted and circular knitted fabrics which are exclusively made of fine untwisted multifilament yarns of a filament denier less than 1 dtex have too soft a handle.

This is why e.g. in suede-like fabrics the warp yarn is preferrably made from coarser filaments and only the weft yarns are made from finer filaments. The same holds true for the upper and lower warp in warp-knitted fabrics. Published European application 0 124 869 discloses a water-repellent textile fabric of high density which in some embodiments uses a synthetic multifilament yarn consisting of a pair of filament yarns of different deniers per filament, with the filament denier of one of said filament bundles being extremely fine and the filament denier of the other filament bundle being substantially coarser. However, this yarn is not a false twisted multifilament yarn. With this yarn the finer and coarser filament bundles are combined by releasing their different shrinkages. This is why this method is relatively complicated both in its performance and in the finish of the fabrics made of these yarns since shrinkage force of these yarns is only minimal.

Furthermore, there are known numerous methods of making a synthetic multifilament yarn of a uniform polymer, consisting of at least two filament bundles of different deniers per filament, with the filament in each of said bundles having the same denier per filament. In these methods the two filament bundles are simultaneously drawtexturized by false twisting after having been spun. The two filament bundles are preoriented differently such that the draw ratio of the filament group having a coarser denier per filament is less than the draw ratio of the filament bundle of the finer denier per filament. The draw ratio is defined as that draw ratio at which drawtexturing of each of the individual filament bundles would result in an elongation at break of 25% (see e.g. German published application 23 08 031, Lenzinger Berichte, issue 47, 1979, page 67, European published application 0 022 065, Chemiefasern-/Textilindustrie, 37./89. issue, February 1987, page 107). However, in these methods filament bundles of substantially different draw ratios are combined in order to generate loops or protruding broken ends by under- and overdrawing of a filament bundle during drawtexturizing thereof in order to generate multifilament yarns of spun-like character.

Finally, methods have become known wherein a false twisted yarn preferrably consisting of bundles of different filament strengths obtains a spun-like character by twisting it in S and Z directions as a result of using an extremely low tension after the texturizing spindle and a slipping of twist caused thereby (see German published application 29 34 762 and European published application 0 022 065). However, these yarns are, similar to spun yarns, not very bulky due to their substantial twist and accordingly are not suited for the intended use.

It is a primary object of the present invention to provide a false twisted bulky synthetic fine filament denier multifilament yarn which is fluffless and without loops and which may be economically manufactured, and a method for making such a multifilament yarn.

According to the present invention a false twisted bulky synthetic multifilament yarn of a uniform polymer, consisting of at least two filament bundles of different filament deniers $ET_1$ and $ET_2$, with the filaments in each of said bundles having the same denier per filament, is characterized in that the finer filament denier $ET_2$ is less than 1 dtex and the total denier T of the texturized yarn is in excess of 100 times the finer filament denier $ET_2$.

The specified selection of the filament deniers of the two filament bundles allows to avoid too soft a handle of fabrics which consist only of filament yarns having a filament denier of less than 1 dtex. Preferrably, only two different spun filament bundles are used in the simultaneous drawtexturizing process. The multifilament yarns of the present invention are bulky. They comprise no filament bundles alternately twisted in S and Z directions, nor core and sheath filament bundles. Preferrably (however not necessarily) the multifilament yarns of the present invention are untwisted.

If the filaments of both filament bundles are of a round cross-section, the ratio $ET_1/ET_2$ of the filament deniers $ET_1$ and $ET_2$ are selected to be in excess of 3 and less than 8. This allows to obtain a sufficient stiffness of the fabric made from the multifilament yarn of the present invention even though the finer filament denier $ET_2$ is less than 1 dtex.

According to a preferred embodiment of the present invention filaments of a round cross-section are used for the finer filament bundle and filaments of a profiled cross-section, preferrably of a distinct y-cross-section, are used for the coarser filament bundle.

Since the profiled cross-section of the multifilament yarns result in an increased stiffness, the ratio $ET_1/ET_2$ should be selected to be in excess of 1.5 and less than 4 in this embodiment.

The synthetic polymers as used may be pure or modified polyesters or polyamids. The polyesters may be produced by direct esterification or indirect esterification and subsequent condensation. Instead of ethylenglycol other dioles like 1,3-propandiole, 1,4 buthandiole etc. may be used and instead of terephthalacid other dicarbon acids like isophthalacid, adipin acid, etc. may be used. The polyamids may be of the type 6 or 6.6 or may be the copolymers thereof.

According to the present invention a method of making a synthetic multifilament yarn of a uniform polymer, consisting of at least two filament bundles of different filament deniers, with the filaments in each of said bundle having the same denier per filament, in which method both of said filament bundles are spun and thereafter are combined drawtexturized (cotexturized) by false twisting, the winding speeds of both filament bundles being selected between 2500 and 5000 m/min and both filament bundles are preoriented at different draw ratios such that the draw ratio $VE_1$ of the filament bundle having the coarser denier per filament is less than the draw ratio $VE_2$ of the filament bundle having the finer denier per filament, with draw ratio being defined as that draw ratio at which drawtexturizing of each of the individual filament bundles will result in an elongation at break of 25%, is characterized in that (a) the spinning deniers of both filament bundles are selected such that the finer filament denier $ET_2$ of the drawtexturized yarn is less than 1 dtex and the total denier T of the drawtexturized yarn is in excess of 100 times $ET_1$, (b) the draw ratios $VE_1$ and $VE_2$ are selected such that their difference $VE_2-VE_1$ is less than 0.1, (c) both filament bundles are cotexturized at a draw ratio corresponding to the draw ratio $VE_1$ of the filament bundle having the coarser denier per filament, (d) the tension of the yarn after having left the texturizing spindle is selected to be in excess of 0.3 cN/dtex.

In the method according to the present invention the orienting of the two filament bundles and the draw ratio for the cotexturizing step are selected so that both filament bundles are elongated at substantially the same tension when they are cotexturized. As a result thereof it has become possible to produce a false twisted fine filament denier fluffless and loop-free multifilament yarn, in contrast to the known cotexturizing methods serving to produce yarns having loops or protruding broken ends. Furthermore, the method of the present invention is extremely economical.

For spinning of the two filament bundles the granular polymer is dried, melt, filtered and pressed through spinning nozzles as in the usual yarn producing process. The resulting multifilament yarns are cooled by an air flow, provided with a spinning finish, intermingled (tangled) and wound on spools. The difference in preorientation of the two filament bundles may be obtained by spinning in different spinning apparatus at different winding speeds. In this case the two filament bundles are combined only when they are drawtexturized.

According to a preferred embodiment of the present invention the difference in preorientation of the two filament bundles is obtained by suitable procedural measures at adjacent spinning positions, i.e. at the same winding speed so that the two filament bundles are combined already after finishing and thereafter are intermingled and wound on spools. These procedural measures for obtaining an increased preorientation of the coarser filament bundle may comprise the profiling of the cross-sections of the filaments. An alternative is an additional heat treatment of the corresponding filament bundle in a tube heated to a temperature of about 80° C. to 150° C., which tube is provided in the area between the blowing means and the finishing means as shown e.g. in European published application 0 013 101, examples 5 and 6 as well as FIG. 2.

Preferred uses of the multifilament yarns of the present invention are water-repellent fabrics, dust-proof fabrics, and the conductive component of sports wear. If only one heater is used for drawtexturizing, high shrinking multifilament yarns result, which are particularly suited for the production of fine porous textile fabrics, for rain-proof and dust-proof fabrics. For the use in double knit articles comprising conductive and absorptive components for physiological 'reasons, a yarn of a shrinkage less than 10% at a temperature of 130° C. is suited; such a yarn is obtained by energizing the second heater for additional heating of the yarn while it is being drawtexturized.

The method according to the present invention will now be described in more detail with respect to the single FIGURE which shows the interrelationship between the spinning denier and the draw ratio of a spun yarn.

In the figure the x-axis represents the filament denier (spinning denier) of the spun yarn (measured in dtex) on a logarithmic scale. The y-axis represents the draw ratio of the spun yarn, with the point of intersection representing a draw ratio of 1:1.0.

As is known the draw ratio VE of the output speed at the second delivery roll and the input speed at the first delivery roll in the texturizing machine is a representation of the degree of orientation of spun yarns. In this context draw ratio is defined as that draw ratio which results in an elongation at break of the texturized yarn of about 25%.

Curves a, b, c in the figure represent the interrelationship between the draw ratio and the spinning denier, with curve a relating to a spun yarn produced at a winding speed of 4000 m/min and having filaments of round cross-section, curve b relating to a spun yarn produced at a winding speed of 3000 m/min and having filaments of a round cross-section, and curve c relating to a spun yarn produced at a winding speed of 3000 m/min and having filaments of a y-cross-section.

It is not surprising that all curves for yarns produced at constant winding speeds merge in the intersecting point of this x-, y-system, i.e. $ET=0.01\rightarrow 0$ and VE 1:1.0. However, it is surprising that the curves of constant winding speeds are straight lines. This facilitates selection of suitable filament bundles (spun yarns) for performing the method of the present invention.

As may be readily understood, the diagram of the FIGURE allows to select the preorientations of the filament bundles so that the difference of their draw ratios $VE_2-VE_1$ is less than 0.1, with the spinning deniers of the two filament bundles being preselected.

The method according to the present invention will now be described in more detail with respect to examples.

EXAMPLE I

A spun yarn 1 of PET is produced at a through-put of 28 g/min by spinning through 22 round holes at a winding speed of 4000 m/min. For testing purposes this spun yarn 1 having a denier of 70f22 is fed into a draw texturizing machine to be drawtexturized at a winding speed of 400 m/min with the draw ratio being set to 1:1.28 and the iron temperature being set to 195° C. The tensile force of the yarn after having left the texturizing spindle is 24 cN. The subsequent breaking test yields the following measured values: tension at break of 36 cN/tex, elongation at break of 24%.

In a similar manner a spun yarn 2 of the same polymer is produced by using 88 round holes at a through-put of 20 g/min and a winding speed of 3000 m/min. After the spun yarn 2 has been drawtexturized in the same draw-texturizing machine at the same temperature and the same winding speed as spun yarn 1, however, at a draw ratio of 1:1.34, with the tensile force of the yarn after having left the texturizing spindle being 23 cN, the following values were measured: tension at break of 37 cN/tex, elongation at break of 25%.

The draw ratio of the two spun yarns 1 and 2 differ for 5%, with the difference being less than 0.1.

For producing a multifilament yarn according to the present invention, the two spun yarns 1 and 2 (filament bundles) are simultaneously drawtexturized at a texturizing position at the conditions of spun yarn 1. The tensile force of the multifilament yarn after having left the texturizing spindle is 51 cN. A fluff- and loop-free multifilament yarn having the following properties results: tension at break of 37 cN/tex, elongation at break of 22%, shrinkage of 41% at a temperature of 130° C. The multifilament yarn has a total denier of 116 dtex and comprises 88 filaments of a filament denier $ET_2$ of 0.6 dtex and 22 filaments of a filament denier $ET_1$ of 2.5 dtex.

For illustration purposes the characteristics of spun yarns 1 and 2 are shown at points A and B in the diagram of the only FIGURE. With respect to all other spun yarns of round cross-section which have been spun in similar apparatus at the winding speeds of 3000 or 4000 m/min, the draw ratios related to the various filament deniers may be read from curves a and b.

EXAMPLE II

In this example filaments of round cross-section are used for spun yarn 2 having a finer denier per filament, and filaments of a profiled cross-section, e.g. of an y-cross-section, are used for spun yarn 1 having a coarser denier per filament. The characteristics of the two spun yarns 1 (corresponding to c in the diagram and 2 are as follows:

| | spun yarn 1 | spun yarn 2 |
|---|---|---|
| denier (dtex) | 72f60 | 70f88 |
| denier per filament (dtex) | 1.2 | 0.8 |
| profile | Y | O |
| winding speed (m/min) | 3000 | 3000 |
| draw ratio | 1:1.31 | 1:1.34 |

The two spun yarns 1 and 2 are spun by adjacent spin nozzles of the same spinning machine, i.e. at the same winding speed. After cooling and finishing of the two spun yarns which were separate so far, they are combined and intermingled before they are wound on spools. The resulting combined spun yarn is drawtexturized at the conditions of spun yarn 1. The tensile force of the yarn after having left the texturizing spindle is 51 cN. The resulting bulky yarn is fluff- and loopless and has the following properties: tension at break of 35 cN/tex, elongation at break of 20%, shrinkage of 45% at 130° C. The multifilament yarn has a total denier of 120 dtex and comprises 88 filaments of round cross-section having a denier $ET_2$ per filament of 0.6 dtex and 60 filaments of an y-cross-section having a denier $ET_1$ per filament of 0.9 dtex.

With this example it is possible to vary the stiffness of the yarn. This will be explained with respect to Example III.

EXAMPLE III

In this example the stiffness of the yarn is increased according to points B′ and C′ in the FIGURE. To this end spinning pumps of different through-puts per revolution are used for the spun yarns 1 and 2 which are spun at adjacent positions. The characteristics of the two spun yarns are as follows.

| | spun yarn 1 | spun yarn 2 |
|---|---|---|
| denier (dtex) | 86f48 | 43f40 |
| denier per filament (dtex) | 1.8 | 1.1 |
| spinning pump (ccm/rotat) | 1.2 | 0.6 |
| profile | Y | O |
| winding speed (m/min) | 3000 | 3000 |
| draw ratio | 1:1.36 | 1:1.39 |

The intermingled combined spun yarn 1 and 2 is drawtexturized at a draw ratio of 1:1.36 and at the same temperature and speed as that of example I. The tensile force of the yarn after having left the texturizing spindle is 52 cN. The resulting bulky multifilament yarn is fluff- and loop-less and has the following properties: tension at break of 36 cN/tex, elongation at break of 23%, shrinkage of 42% at 130° C. The denier is 118 dtex. The multifilament yarn comprises 40 filaments of round cross-section having a filament denier $ET_2$ of 0.8 dtex and 48 filaments of an y-cross-section having a filament denier $ET_1$ of 1.3 dtex.

The following comparative examples show that 1. it is not possible to produce a fluffless yarn by combining fine denier spun yarns prior to texturizing thereof;
2. it is not possible to produce a yarn suited for the intended use by combining fine and coarse denier texturized yarns. This object is achieved only by the present invention.

Comparative Example I

Two spun yarns 2 from two spinning spools of example I having a denier of 67f88 are simultaneously texturized at a draw ratio of 1:1.34 and at the conditions described with respect to example I. A fluffy yarn results. The same holds true if the draw ratios are decreased in steps to 1:1.28, 1:1.24 and 1:1.20; this means that no suitable texturizing conditions may be found with respect to this yarn.

Comparative Example II

The spun yarns 1 and 2 described in example I are simultaneously texturized at two adjacent texturizing positions at the conditions as defined in example I, i.e. at draw ratios of 1:1.28 and 1:1.34, respectively. As a result thereof, the two filament bundles are fed from the texturizing zone to the spool assembly at the same tension. Despite of these optimum conditions it was not possible to intermingle both yarns by the action of an air flow sufficiently so as would be necessary for suitable warps. Immediately after the texturizing process spun yarn 2 having the finer filament denier of 0.6 dtex is so thoroughly intermingled that it may not be opened by an air flow sufficiently as would be necessary for perfect intermingling of both yarns.

As these examples show, it is only the present invention which allows to produce perfect false twisted bulky (preferrably untwisted) multifilament yarns having a filament denier $ET_2$ of less than 1 dtex and a total denier in excess of $100 \times ET_2$.

I claim:

1. A false twisted bulky synthetic multifilament yarn of a uniform polymer, consisting of at least two filament bundles of different filament deniers $ET_1$ and $ET_2$, with the filaments in each of said bundles having the same denier per filament, characterized in that the finer filament denier $ET_2$ is less than 1 dtex and the total denier T of the texturized yarn is in excess of 100 times the finer filament denier $ET_2$.

2. A false twisted bulky synthetic multifilament yarn as claimed in claim 1, wherein the ratio $ET_1/ET_2$ of the total deniers $T_1$ and $T_2$ of both filament bundles are in excess of 3/7 and less than 7/3.

3. A false twisted bulky synthetic multifilament yarn as defined in claim 1 or claim 1, wherein the ratio $ET_1/ET_2$ of the filament deniers $ET_1$ and $ET_2$ is in excess of 3 and less than 8, with the filaments of both filament bundles being of round cross-section.

4. A false twisted bulky synthetic multifilament yarn as claimed in claim 1 or claim 2, wherein the ratio of $ET_1/ET_2$ of the filament deniers $ET_1$ and $ET_2$ is in excess of 1.5 and less than 4, with the filaments of the filament bundle having the finer denier per filament being of round cross-section and the filaments of the filament bundle having the coarser denier per filament being of a profiled cross-section.

5. A method of making a synthetic multifilament yarn of a uniform polymer, consisting of at least two filament bundles of different filament deniers, with the filaments in each of said bundles having the same denier per filament, in particular according to any of the preceding claims, in which method both of said filament bundles are spun and thereafter are combined and drawtexturized (cotexturized) by false twisting, the winding speeds of both filament bundles being selected between 2500 and 5000 m/min and both filament bundles are preoriented at different draw ratios such that the draw ratio $VE_1$ of the filament bundle having the coarser denier per filament is less than the draw ratio $VE_2$ of the filament bundle having the finer denier per filament, with draw ratio being defined as that draw ratio at which drawtexturizing of each of the individual filament bundles will result in an elongation at break of 25%, characterized in that (a) the spinning deniers of both filament bundles are selected such that the finer filament denier $ET_2$ of the drawtexturized yarn is less that 1 dtex and the total denier T of the drawtexturized yarn is in excess of 100 times $ET_2$, (b) the draw ratios $VE_1$ and $VE_2$ are selected such that their difference $VE_2 - VE_1$ is less than 0.1, (c) both filament bundles are combined and drawtexturized at a draw ratio corresponding to the draw ratio $VE_1$ of the filament bundle having the coarser denier per filament, (d) the tension of the yarn after having left the texturizing spindle is selected to be in excess of 0.3 cN/dtex.

6. A method as claimed in claim 5, wherein both filament bundles are spun at different winding speeds to obtain different preorientations thereof and are combined only when being drawtexturized.

7. A method as claimed in claim 5, wherein both filament bundles are spun at the same winding speed with different orientations and are simultaneously wound before they are drawtexturized.

8. End use of a yarn as claimed in claim 1 having a shrinkage of more than 10% at a temperature of 180° C. for making water-repellent woven fabrics or knit wear.

9. End use of a yarn as claimed in claim 1 having a shrinkage of more than 10% at a temperature of 130° C. for making of fine porous woven fabrics or knit fabrics for dust-proof wear.

10. End use of a yarn as claimed in claim 1 having a shrinkage of less than 10% at a temperature of 130° C. as the conductive component in the making of sports wear.

* * * * *

UNITED STATES PATENT AND TRADEMARK OFFICE

CERTIFICATE OF CORRECTION

PATENT NO. : 4,845,934

DATED : July 11, 1989

INVENTOR(S) : Gunther Bauer

It is certified that error appears in the above-identified patent and that said Letters Patent is hereby corrected as shown below:

Column 5, line 42, after "diagram" insert —)—.

Column 7, line 20, Claim 2, delete "or claim 1".

Column 7, line 25, Claim 4, delete "or claim 2".

Signed and Sealed this

Tenth Day of July, 1990

*Attest:*

HARRY F. MANBECK, JR.

*Attesting Officer*

*Commissioner of Patents and Trademarks*